United States Patent [19]

Stoltman

[11] 4,275,697

[45] Jun. 30, 1981

[54] CLOSED LOOP AIR-FUEL RATIO CONTROL SYSTEM

[75] Inventor: Donald D. Stoltman, Henrietta, N.Y.

[73] Assignee: General Motors Corporation, Detroit, Mich.

[21] Appl. No.: 165,971

[22] Filed: Jul. 7, 1980

[51] Int. Cl.[3] ..... F02M 7/20

[52] U.S. Cl. ..... 123/520; 261/67; 261/DIG. 74; 251/65

[58] Field of Search ..... 123/518-520, 123/521; 261/67, DIG. 74; 251/65

[56] References Cited

U.S. PATENT DOCUMENTS

| | | | |
|---|---|---|---|
| 3,680,318 | 8/1972 | Nakajima et al. | 123/519 |
| 3,683,597 | 8/1972 | Beveridge et al. . | |
| 4,013,054 | 3/1977 | Balsley et al. . | |
| 4,127,097 | 11/1978 | Takimoto | 123/520 |
| 4,175,526 | 11/1979 | Phelan | 123/520 |

OTHER PUBLICATIONS

Research Disclosure 16601, FIG. 1, Feb. 1978.

"An Adsorption-Regeneration Approach to the Problem of Evaporative Control", S.A.E. Report 670127, 1-9-67, 123-519.

*Primary Examiner*—Tim R. Miles

*Attorney, Agent, or Firm*—C. K. Veenstra

[57] ABSTRACT

A command signal drives a carburetor metering valve to provide the carburetor fuel flow which will establish a desired air-fuel ratio; simultaneously, the command signal drives a control unit which purges fuel vapor from a fuel vapor storage region. The control unit minimizes purge flow when either maximum fuel flow or minimum fuel flow is commanded and maximizes purge flow when an intermediate fuel flow is commanded; accordingly, fuel vapor is purged from the vapor storage region only when the purge flow cannot unduly enrich or unduly lean the mixture.

1 Claim, 1 Drawing Figure

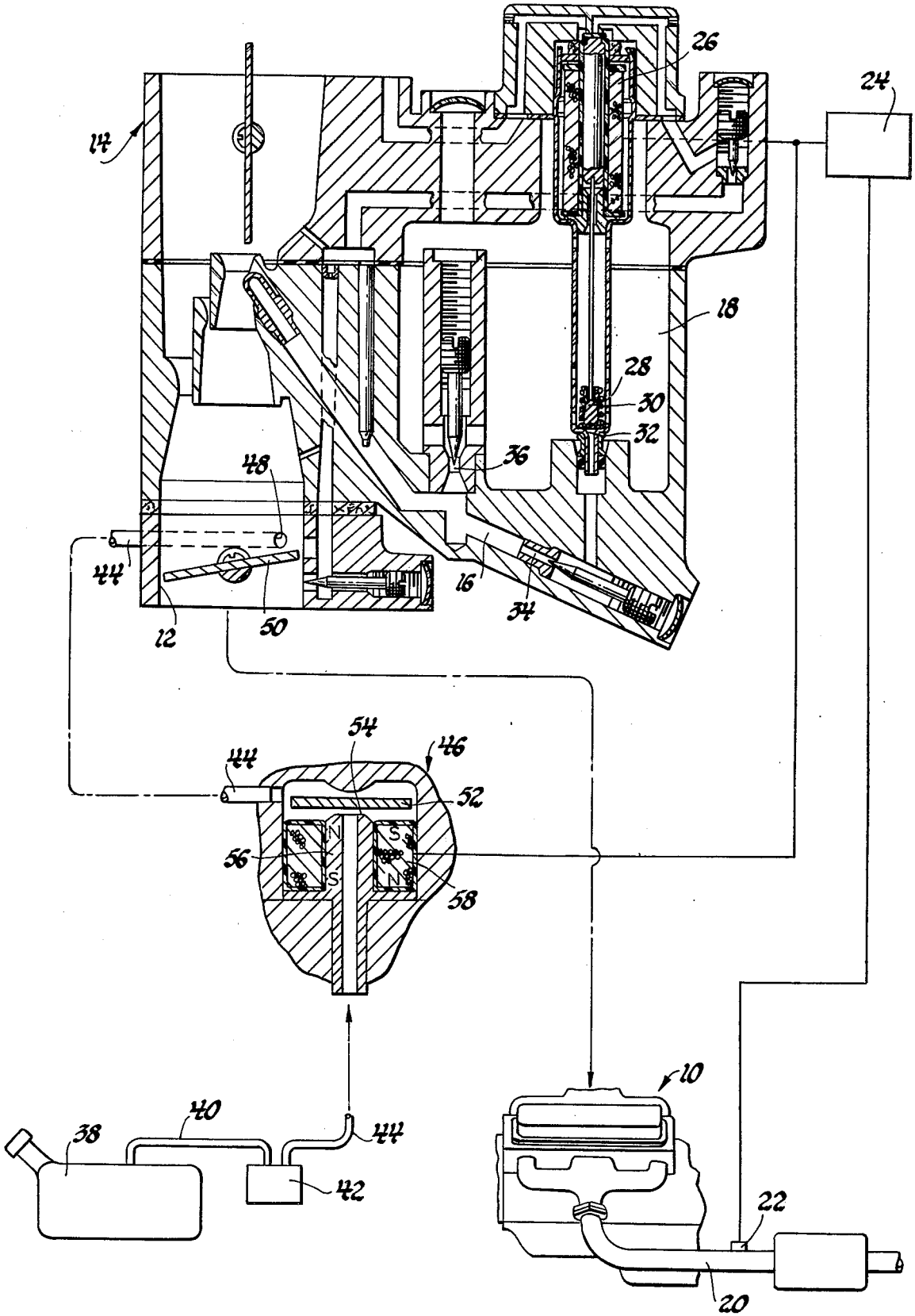
26
24
14
18
28
30
32
36
48
44
16
34
12
50
54
46
44
52
N
S
56
S
N
58
10
40
38
44
42
22
20

CLOSED LOOP AIR-FUEL RATIO CONTROL SYSTEM

TECHNICAL FIELD

This invention relates to a closed loop system for controlling the air-fuel ratio of a mixture of air and fuel delivered to an engine.

BACKGROUND

Current automotive engine control systems include an air-fuel ratio control system having an electromechanical carburetor in which a solenoid is energized according to a command signal and positions a metering valve to control the carburetor fuel flow. The carburetor mixes the fuel with air, and a sensor measures the air-fuel ratio of the mixture. The output of the sensor then adjusts the command signal to provide the fuel flow which will achieve the air-fuel ratio desired.

Current automotive engine control systems also include a fuel vapor storage canister which captures fuel vapor vented from the vehicle fuel tank. During engine operation, air is drawn through the canister to purge the captured fuel vapor from the canister into the engine induction system. During initial operation, the purge flow from the canister may have a high concentration of fuel vapor; after prolonged operation, however, the purge flow from the canister will have a low concentration of fuel vapor.

It will be appreciated that if the carburetor is commanded to minimize fuel flow at a time when the purge flow has a high concentration of fuel vapor, the mixture delivered to the engine may not have the desired air-fuel ratio. Similarly, if the carburetor is commanded to maximize fuel flow at a time when the purge flow has a low concentration of fuel vapor, the desired air-fuel ratio may not be achieved.

SUMMARY OF THE INVENTION

This invention provides a closed loop air-fuel ratio control system in which the purge flow is automatically minimized when the carburetor is commanded to provide either maximum or minimum fuel flow and in which the purge flow is maximized when the carburetor is commanded to provide an intermediate fuel flow.

In the preferred embodiment of this invention, a purge valve controls the purge flow in response to the magnetic forces of both a permanent magnet and a purge control solenoid. The purge control solenoid is energized with the same command signal as the carburetor solenoid. When a minimum fuel command signal is delivered to the purge control solenoid, the solenoid biases the purge valve closed to minimize purge flow, and when a maximum fuel command signal is delivered to the purge control solenoid, the permanent magnet biases the purge valve closed to minimize purge flow. When an intermediate fuel flow command signal is delivered to the purge control solenoid, the bias created by the purge control solenoid opposes the bias of the permanent magnet, and the purge valve opens to purge fuel vapor from the fuel vapor storage region.

The details as well as other features and advantages of this invention are set forth in the remainder of the specification and are shown in the accompanying drawing.

SUMMARY OF THE DRAWING

The sole FIGURE of the drawing is a schematic view of an engine having one embodiment of this closed loop air-fuel ratio control system.

BEST MODE FOR CARRYING OUT THE INVENTION

Referring to the drawing, an engine 10 receives air through the induction passage 12 of a carburetor 14. Carburetor 14 has a main fuel passage 16 which delivers fuel from a fuel bowl 18 to induction passage 12. The fuel delivered to induction passage 12 is mixed with the air received through passage 12, the resulting air-fuel mixture is burned in engine 10, and exhaust gases are expelled from engine 10 through an exhaust system 20.

A sensor 22 measures the oxygen content of the exhaust gases and provides a signal to an electronic control unit 24 which is indicative of the air-fuel ratio of the mixture provided to engine 10.

Electronic control unit 24 provides a pulse width modulated duty cycle to a carburetor solenoid 26. When energized, solenoid 26 pushes a main metering valve 28 downwardly against the bias of a spring 30 so that metering valve 28 engages a seat 32 and interrupts fuel flow through a metering orifice 34 to main fuel passage 16; thus when solenoid 26 is energized, main fuel passage 16 delivers fuel only from a metering orifice 36 to induction passage 12. When solenoid 26 is deenergized, spring 30 lifts metering valve 28 and main fuel passage 16 delivers fuel both from orifice 34 and from orifice 36 to induction passage 12.

If the air-fuel ratio measured by sensor 22 is richer than desired, electronic control unit 24 will increase the duty cycle of solenoid 26, thus commanding metering valve 28 to engage seat 32 a greater proportion of the time and thereby reduce fuel flow through orifice 34 to lean the mixture delivered to engine 10. If the air-fuel ratio measured by sensor 22 is leaner than desired, electronic control unit 24 will reduce the duty cycle delivered to solenoid 26, thus commanding metering valve 28 to engage seat 32 a lesser proportion of the time and thereby increase fuel flow through orifice 34 to enrich the mixture delivered to engine 10.

The construction of carburetor 14 is well known and need not be set forth in detail here. Reference may be made to U.S. patent application Ser. No. 51,978 filed June 25, 1979 in the names of D. D. Brokaw and R. D. Giampa for additional understanding of that construction. Moreover, it will be appreciated that carburetors of other construction may be substituted for carburetor 14 when making use of this invention.

A fuel tank 38 provides fuel to carburetor fuel bowl 18 by way of a fuel pump and fuel line which are not shown. When the pressure in tank 38 increases, a mixture of fuel vapor and air is expelled through a fuel tank vent line 40 to a fuel vapor storage bed disposed within a canister 42. The vapor storage bed adsorbs the fuel vapor, while the air passes through the storage bed and on out the bottom of canister 42. The construction of canister 42 is also well known and need not be set forth in detail here. Reference may be made to U.S. Pat. No. 3,683,597 issued Aug. 15, 1972 in the names of T. R. Beveridge and E. L. Ranft for additional understanding of that construction.

A purge line 44 extends from canister 42 through a purge control unit 46 to a purge port 48 opening into induction passage 12 adjacent the edge of throttle 50.

When throttle 50 is open, port 48 is subjected to the subatmospheric induction passage pressure downstream of throttle 50.

Purge control unit 46 includes a magnetically responsive valve member 52 which is associated with a valve seat 54 disposed at the end of a sleeve 56. Sleeve 56 is formed as a permanent magnet and is surrounded by the winding of a purge control solenoid 58. Purge control solenoid 58 is energized by electronic control unit 24 simultaneously with carburetor solenoid 26, and the winding of solenoid 58 is disposed so that the bias of solenoid 58 on valve member 52 is opposite to the bias of permanent magnet sleeve 56 on valve member 52. When purge control solenoid 58 is energized with a minimum duty cycle, permanent magnet sleeve 56 attracts valve member 52 into engagement with seat 54 to interrupt flow through purge line 44. Similarly, when purge control solenoid 58 is energized with a maximum duty cycle, solenoid 58 attracts valve member 52 into engagement with seat 54 and interrupts flow through purge line 44. However, when solenoid 58 is energized with an intermediate duty cycle, the bias of permanent magnet sleeve 56 is opposed by the bias of solenoid 58, and the subatmospheric pressure at port 48 lifts valve member 52 away from seat 54; the subatmospheric pressure then applied from port 48 through purge line 44 to canister 42 draws air through the bottom of canister 42 and purges fuel vapor from the storage bed into induction passage 12.

After a prolonged period of inactivity, canister 42 will have adsorbed a substantial quantity of fuel vapor emitted through fuel tank vent line 40. Thus during initial engine operation, the flow through purge line 44 may have a high concentration of fuel vapor. After a prolonged period of operation, however, flow through purge line 44 will have purged most of the vapor from canister 42, and the flow through purge line 44 will have a low concentration of fuel vapor.

When an intermediate fuel flow is required to achieve the desired air-fuel ratio, electronic control unit 24 produces an intermediate duty cycle and carburetor solenoid 26 causes metering valve 28 to provide an intermediate fuel flow through orifice 34; simultaneouly, purge control solenoid 58 offsets the bias of permanent magnet sleeve 56 and the subatmospheric pressure at port 48 lifts valve member 52, drawing air through canister 42 to purge the captured fuel vapor into induction passage 12. If the purge flow contains a high concentration of fuel vapor and enriches the air-fuel mixture delivered to engine 10, sensor 22 will signal electronic control unit 24 to increase the duty cycle and carburetor solenoid 26 will cause metering valve 28 to reduce fuel flow through orifice 34. If the purge flow contains a low concentration of fuel vapor and leans the air-fuel mixture delivered to engine 10, sensor 22 will signal electronic control unit 24 to decrease the duty cycle and carburetor solenoid 26 will cause metering valve 28 to increase fuel flow through orifice 34.

However, flow through purge line 44 does not disturb the air-fuel ratio beyond the desired limits of control. When minimum fuel flow is required to achieve the desired air-fuel ratio, electronic control unit 24 produces a maximum duty cycle and carburetor solenoid 26 causes metering valve 28 to minimize fuel flow through orifice 34; simultaneously, purge control solenoid 58 attracts valve member 52 to valve seat 54 to minimize the purge flow and prevent a potentially high concentration of fuel vapor in the purge flow from enriching the air-fuel mixture delivered to engine 10 beyond the desired air-fuel ratio. Similarly, when maximum fuel flow is required to achieve the desired air-fuel ratio, electronic control unit 24 delivers a minimum duty cycle and carburetor solenoid 26 causes metering valve 28 to permit maximum fuel flow through metering orifice 34; simultaneously, permanent magnet sleeve 56 attracts valve member 52 to valve seat 54 to minimize purge flow and prevent a potentially low concentration of fuel vapor in the purge flow from leaning the air-fuel mixture delivered to engine 10 beyond the desired air-fuel ratio.

Accordingly, fuel vapor is purged from canister 42 only when the fuel vapor in the purge flow cannot unduly enrich the mixture provided to engine 10 and only when the air in the purge flow cannot unduly lean the mixture provided by engine 10.

The embodiments of the invention in which an exclusive property or privilege is claimed are defined as follows:

1. A closed loop air-fuel ratio control system for an engine having an air induction passage for receiving a flow of air, a main fuel passage for receiving a flow of liquid fuel, and a purge passage for receiving fuel vapor and air from a fuel vapor storage region, said engine being effective to combine the fluids received through said passages into an air-fuel mixture, said air-fuel ratio control system comprising the combination of means responsive to the air-fuel ratio of said mixture for producing a signal indicative of the fuel flow required to provide a desired air-fuel ratio, a metering valve in said main fuel passage, said metering valve being responsive to said signal for varying fuel flow through said fuel passage generally linearly with said signal, and a purge valve in said purge passage, said purge valve being responsive to said signal for minimizing flow through said purge passage when said signal approaches its maximum and its minimum values and for maximizing flow through said purge passage when said signal is intermediate its maximum and minimum values, whereby fuel vapor purged from said region is used to provide the desired air-fuel ratio only when fuel vapor purged from said region cannot unduly enrich said mixture and air purged from said region cannot unduly lean said mixture.

* * * * *